US009033685B1

(12) United States Patent
Await

(10) Patent No.: US 9,033,685 B1
(45) Date of Patent: May 19, 2015

(54) WELL PUMP FLOW SLEEVE INSTALLATION ASSEMBLY AND METHOD

(76) Inventor: Rex N. Await, Paso Robles, CA (US)

( * ) Notice: Subject to any disclaimer, the term of this patent is extended or adjusted under 35 U.S.C. 154(b) by 1063 days.

(21) Appl. No.: 13/092,013

(22) Filed: Apr. 21, 2011

Related U.S. Application Data

(60) Provisional application No. 61/327,794, filed on Apr. 26, 2010.

(51) Int. Cl.
*F04B 39/12* (2006.01)
*F04B 47/00* (2006.01)

(52) U.S. Cl.
CPC ..... *F04B 47/00* (2013.01); *F04B 39/121* (2013.01)

(58) Field of Classification Search
CPC ..... F04B 39/121
USPC ..... 417/423.3, 424.1; 166/105
See application file for complete search history.

(56) References Cited

U.S. PATENT DOCUMENTS

| | | | | |
|---|---|---|---|---|
| 4,126,406 | A | 11/1978 | Traylor et al. | |
| 4,516,044 | A | 5/1985 | Bone | |
| 4,745,316 | A | 5/1988 | Nakashima et al. | |
| 4,854,373 | A | 8/1989 | Williams | |
| 5,271,725 | A | 12/1993 | Freet et al. | |
| 5,480,290 | A | 1/1996 | Zelder | |
| 5,554,897 | A | 9/1996 | Martin et al. | |
| 5,906,236 | A | 5/1999 | Adams et al. | |
| 6,033,567 | A | 3/2000 | Lee et al. | |
| 6,126,416 | A | 10/2000 | Lee | |
| 6,273,677 | B1 * | 8/2001 | Wang et al. | 415/191 |
| 6,547,003 | B1 | 4/2003 | Bangash et al. | |
| 6,595,295 | B1 * | 7/2003 | Berry et al. | 166/369 |
| 7,188,669 | B2 | 3/2007 | Bullock et al. | |
| 7,239,056 | B1 | 7/2007 | Griggs et al. | |
| 7,299,873 | B2 | 11/2007 | Hartman et al. | |
| 7,487,838 | B2 | 2/2009 | Knight et al. | |
| 2002/0153141 | A1 | 10/2002 | Hartman et al. | |
| 2005/0217859 | A1 | 10/2005 | Hartman et al. | |
| 2006/0017335 | A1 | 1/2006 | Matin et al. | |
| 2006/0081377 | A1 | 4/2006 | Bullock et al. | |
| 2009/0053080 | A1 | 2/2009 | Ives et al. | |

FOREIGN PATENT DOCUMENTS

| | | |
|---|---|---|
| DE | 3705840 | 2/1987 |
| DE | 102005034341 | 1/2007 |
| SU | 918540 | 4/1982 |

* cited by examiner

*Primary Examiner* — Christopher Bobish
(74) *Attorney, Agent, or Firm* — William Keyworth; Bill & Mary Lou Inc.

(57) ABSTRACT

The well pump flow sleeve assembly provides a method of quickly fitting a flow sleeve to a well pump. The sleeve is made by cutting a pipe normal to the pipe centerline of the pipe surfaces, to a length appropriate for the well pump length. A pump centering bottom cap is inserted into the pipe lower opening and the well pump assembly is then inserted into the pipe upper opening and mates with the bottom cap to align the pump in the sleeve. The pump is now completely within the sleeve with the pump discharge and electrical connection extending through the pipe upper opening. Two flow sleeve cap halves are then fitted around the pump discharge and electrical connection/safety rope to form an upper cap which is inserted into the pipe upper opening. The submersible pump is then ready for service.

11 Claims, 3 Drawing Sheets

WELL PUMP FLOW SLEEVE INSTALLATION ASSEMBLY AND METHOD

CROSS-REFERENCE TO RELATED APPLICATIONS

This application claims the benefit of priority from Provisional Patent Application No. 61/327,794 "Well Pump Flow Sleeve Assembly and Method" filed Apr. 26, 2010, which is incorporated herein by reference in its entirety.

STATEMENT REGARDING FEDERALLY SPONSORED RESEARCH AND DEVELOPMENT

Not Applicable.

BACKGROUND OF THE INVENTION

1. Field of the Invent

This invention relates to an article of manufacture that provides for fast and accurate installation and alignment of a submersible well pump fluid flow sleeve, also sometimes referred to as a shroud.

2. Description of Related Art

Manufacturers of submersible well pumps recommend installing a sleeve around their pumps for many applications of the pump. These sleeves are installed over the body of the submersible pump and motor so that the water flow past the motor is sufficient to achieve adequate cooling of the motor. The pump and motor dimensions are such that the sleeve can be made from common sizes of PVC pipe.

Examples of applications where a sleeve is required are an open body of water, eg. a dam, river, pond, uncased bore hole, or a cascading bore; or if the pump is to be installed below water pumping level. The sleeve then protects the pump from excessive heating during operation and ensures correct velocity of water over the motor.

Ideally the flow sleeve is a tube open only at the bottom, below the pump motor, which ensures that fluid below the pump flows upwards over the motor casing on its way to the pump intake. It should be sized to provide sufficient flow velocity past the motor for proper cooling, as per manufacturer's specifications. There is no standard for constructing the sleeve. Substantial effort is required to construct one which comes close to the ideal. What is needed are the fittings and method to quickly construct and install a well pump flow sleeve which provides for proper pump motor cooling.

SUMMARY OF THE INVENTION

The well pump flow sleeve assembly provides a method of quickly fitting a flow sleeve to a well pump with a discharge end at the top, a motor end at the bottom, and a centrally located pump suction, by selecting a piece of pipe of compatible inside diameter and wall thickness for the well pump diameter, and cutting that piece of pipe, 90 degree to the pipe centerline of the pipe surfaces, to a length appropriate for the well pump motor length, forming a pipe section with an inside and an outer surface, and an upper opening and a lower opening substantially normal to the centerline of the inside and outer surfaces forming upper and lower pipe wall surfaces.

A pump centering bottom cap with two or more insertion surfaces arranged to fit within the pipe section inside surface, an end cover surface, two or more well pump centering surfaces and a pump support surface with flow openings is inserted into the pipe lower opening until the end cover surface contacts the pipe lower wall surface with the insertion surface inside the pipe inside surface.

The well pump assembly is then lowered into the pipe upper opening until the lower end of the pump assembly is inside the bottom cap well pump centering surfaces and in contact with the pump support surface such that the pump assembly is completely within the pipe with the pump discharge and electrical connection extending through the pipe upper opening.

Two upper cap halves mating surfaces are then fitted around the pump discharge and electrical connection to form an upper cap, with an insert surface and an end cover surface, and the upper cap is inserted into the pipe upper opening until the end cover surface contacts the pipe upper wall surface. The submersible pump is then ready for service in the well.

In operation, the shrouded pump has pumped fluid flow through the bottom cap flow openings, around the motor with a swirling flow path caused by flow guides in the bottom cap flow openings, to the pump suction and then out the pump discharge.

Objects and Advantages

The objective of the invention is to provide the fittings and method to quickly construct and install a well pump sleeve, which provides for pump motor cooling.

BRIEF DESCRIPTION OF THE SEVERAL VIEWS OF THE DRAWINGS

A more complete understanding of the present invention can be obtained by considering the detailed description in conjunction with the accompanying drawings, in which.

REFERENCE NUMERALS IN DRAWINGS

Figure 1:
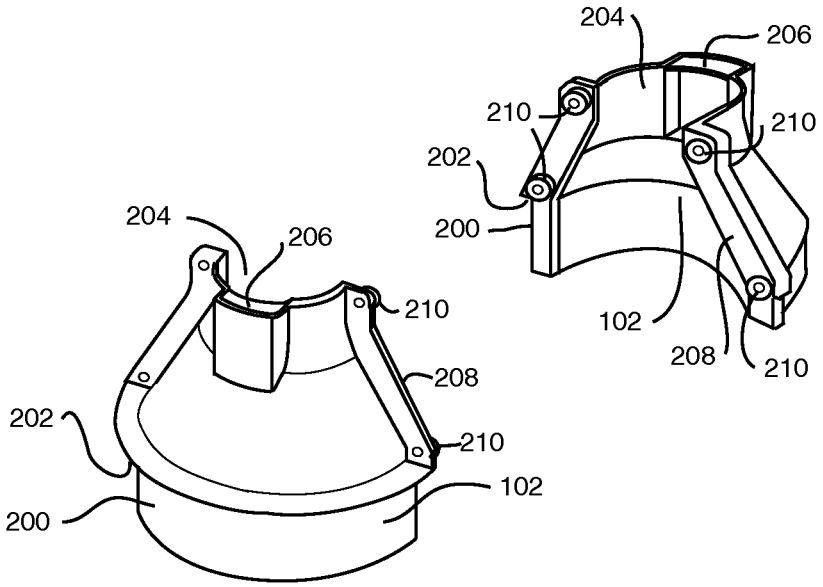
FIG. 1 is a perspective view of two flow sleeve upper cap halves arranged separate from each other.

These reference numbers are used in the drawings to refer to areas or features of the invention.

102 Flow Sleeve Upper Cap Half
104 Pump Centering Bottom Cap
106 Pipe Section
107 Pipe Section End
108 Submersible Pump
110 Submersible Pump Discharge
112 Submersible Pump Electrical Connection
113 Safety Rope
114 Submersible Pump Motor
200 Upper Cap Half Insert Surface
202 Upper Cap Half End Cover Surface

204 Upper Cap Discharge Opening
206 Upper Cap Wiring/Safety Rope Breakaway
208 Upper Cap Half Mating Surface
210 Upper Cap Alignment Protrusion/Opening
300 Bottom Cap Insert Surface
302 Bottom Cap End Cover Surface
304 Bottom Cap Well Pump Centering Surface
306 Bottom Cap Flow Opening
308 Bottom Cap Flow Guide
310 Bottom Cap Pump Support Surface
312 Bottom Cap Support
400 Removable Fasteners
500 Pump Centerline
502 Flow into Bottom Cap
504 Swirl Motion Flow

DETAILED DESCRIPTION OF THE INVENTION

Figure 2:
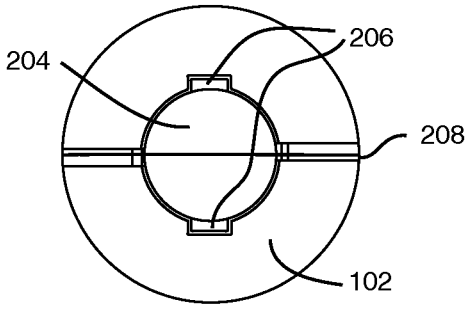
FIG. 2 is a top view of two flow sleeve upper cap halves arranges adjacent to each other.
Figure 3:
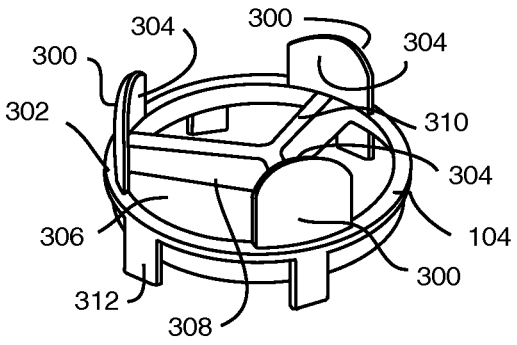
FIG. 3 is a perspective view of the motor centering bottom cap.
Figure 4:
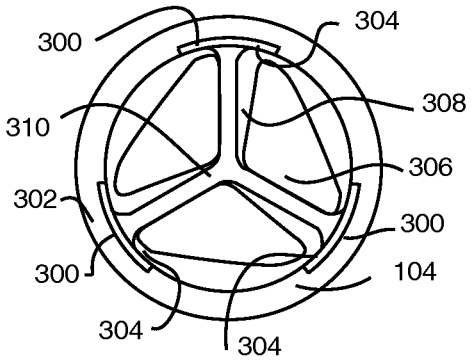
FIG. 4 is a top view of the motor centering bottom cap.
Figure 5:
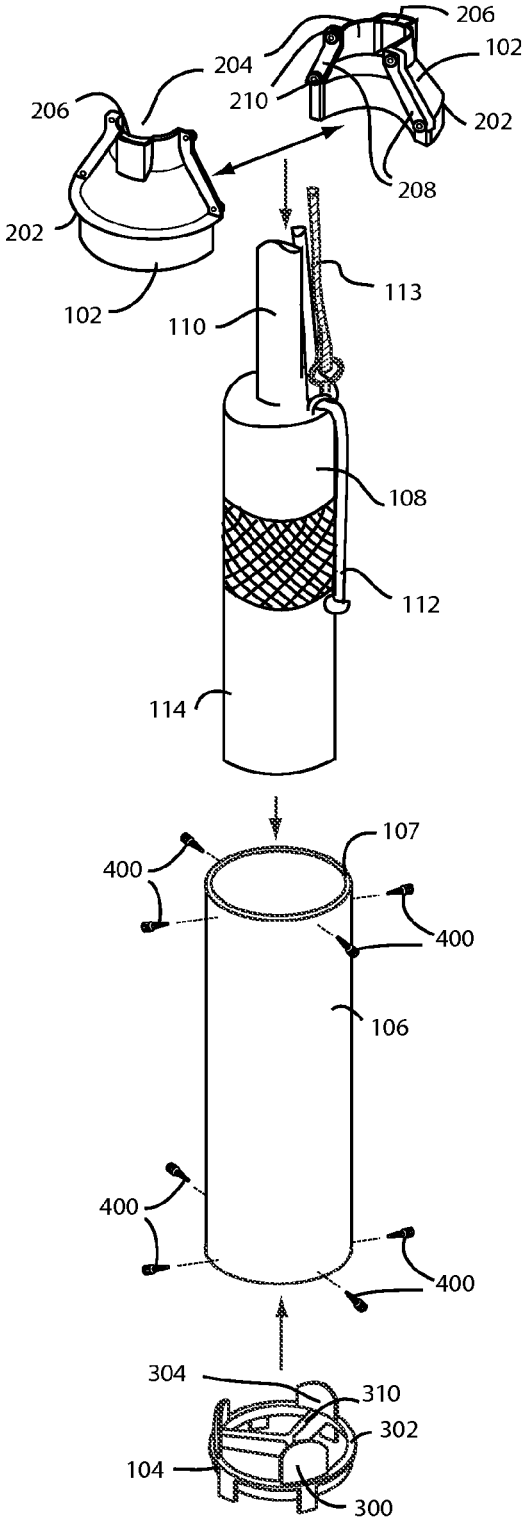
FIG. 5 is an exploded perspective view of two flow sleeve cap halves, the submersible pump assembly, the sleeve, and a motor centering bottom cap. Arrows show the direction of assembly.
Figure 6:
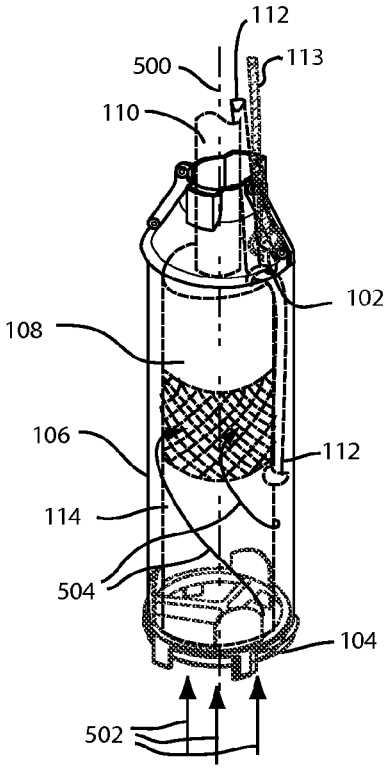
FIG. 6 is a perspective view of the assembled two flow sleeve upper cap halves, the submersible pump assembly, the sleeve, and the motor centering bottom cap. The portion of the submersible pump assembly and motor centering bottom cap located inside the sleeve wall is shown in hidden lines. Arrows show the flow path of liquid into the pump suction with the pump operating.

The well pump flow sleeve installation assembly and method is illustrated in FIGS. 1 through 6. FIGS. 1 and 2 show the flow sleeve upper cap halves (102), FIGS. 3 and 4 show the pump centering bottom cap (104) and FIGS. 5 and 6 show the assembly of the caps onto a pipe section (106) with length and inside diameter sized to encase a submersible pump (108) of known dimensions.

FIG. 1 shows two flow sleeve upper cap halves (102). FIG. 2 shows a top view of two flow sleeve upper cap halves (102) assembled together. Each upper cap half (102) has an insert surface (200) which, when the cap halves are joined, is sized to conform to and fit within the inside diameter of the pipe section used for the sleeve. The pipe section (106) is shown in FIGS. 5 and 6. Each upper cap half (102) also has an end cover surface (202) which, when the cap halves are joined, mates with the end of the pipe section (106) used for the sleeve. With the two flow sleeve upper cap halves (102) joined as in FIG. 2, they also form a discharge opening (204) through which the submersible pump (108) discharge (110) passes. Adjacent to the discharge opening (204) is the wiring/safety rope breakaway (206). The breakaway (206) is a closure that can be prepared for installation by removal with a simple hand tool, such as pliers, to form an opening that provides means for passage of the well pump electrical connection (112) and safety rope (113) through the breakaway (206) on one half of the upper cap, while usually the wiring/safety rope breakaway (206) on the opposite half remains in place to stop fluid flow and possible ingress of debris through the opening. The discharge opening is thus adjustable for the pump connection configuration.

Each flow sleeve upper cap half (102) has a mating surface (208) on each side of the cap half. These are formed with at least two alignment protrusion/opening (210) combinations that provide means for precise alignment of the two halves mating surfaces (208) when the mating surfaces are in contact by the protrusion inserting into the appropriate opening. These protrusion/opening (210) combinations may be of other configurations than the round ones shown. The protrusion/opening (210) may have a through opening, as shown, that permits securing the two flow sleeve upper cap halves (102) together with a fastener, which isn't shown.

FIGS. 3 and 4 show the pump centering bottom cap (104). The bottom cap (104) is formed with protrusions on the upper surface that form a bottom cap insert surface (300) arranged to fit within, support, and center the bottom cap (104) in the inside diameter of the pipe section used for the sleeve providing pipe support means. The pipe section (106) is shown in FIGS. 5 and 6. A section of the upper surface of the bottom cap (104) radially outward from the protrusions forms an end cover surface (302) that provides a mating surface with the end of the pipe section (107) used for the sleeve. Protrusions, which may be the same as form the insert surface, or separate, form a well pump centering surface (304) that is arranged to fit around the lower portion of the submersible pump (108) as shown in FIG. 6, providing radial pump motor restraint means. Radially inward of the centering surfaces (304) protrusions is a section of the upper surface forming the well pump support surface (310) and providing axial pump restraint means. The centering bottom cap (104) contains flow openings (306) configured to allow flow of the fluid in which the submersible pump (108) is installed from below the pump centering bottom cap (104) to the pump contained within the sleeve. The flow openings (306) are arranged with flow guides (308) that impart a swirl motion, providing motion at an angle with the pump centerline (500), to the incoming fluid flow with the pump (108) in operation. This swirl motion is illustrated by the flow arrows (502) and (504) in FIG. 6. Bottom cap supports (312) provide a stable support for the installed pump sleeve and prevent the sleeve from touching the side of the motor, causing motor hot spots.

The pump centering bottom cap (104) and upper flow sleeve cap halves (102) are manufactured of materials suitable for service in the pumping environment. Molded plastics, various cast metals, or stamped sheet metals are among the candidates for evaluation for manufacturing. Some cast or stamping processes may require some final machining to provide desired dimensions within tolerances.

Operation

The well pump flow sleeve assembly installation on a submersible pump is illustrated in FIG. 5. An appropriate size pipe (106) section is cut to a size for the pump from a length of piping to form the sleeve. The pump centering bottom cap (104) insert surfaces (300) are slid into the bottom opening of the pipe (106) section until the end cover surface (302) mates with the pipe end. The submersible pump (108) is then inserted into the top opening of the pipe (106) section so the bottom of the pump is within the pump centering bottom cap (104) well pump centering surfaces (304) and in contact with the pump support surface (310). This leaves the pump entirely within the sleeve with the pump discharge (110) and electrical connection (112) extending through the pipe upper opening. Two mating upper flow sleeve cap halves (102) are then selected. One half has the wiring/safety rope breakaway (206) removed, and the two halves are then joined together with their alignment protrusion/openings (210) aligned and their mating surfaces (208) in contact, with the pump electrical connection fitted in the opening created by the removal of the wiring breakaway (206) and the pump discharge in the discharge opening (204). The joined upper flow sleeve cap halves (102) are then inserted into the pipe upper opening until their end cover surface (202) is in contact with the pipe end. Fasteners (400), appropriate for the pumping environment may be installed to secure the pump centering bottom cap (104) and upper flow sleeve cap halves (102) to the pipe section as shown. This completes installation of the sleeve on the pump and it is in the configuration as shown in FIG. 6.

Those familiar with the art will recognize that the preferred and other embodiments described have other possible variations. The descriptions of the invention provided are not intended to limit the invention.

I claim:

1. An installation assembly for a submersible pump fluid flow sleeve, including a flow sleeve made of a pipe section, the pipe section with a top end opening and a bottom end opening and the pipe section with a length and inside diameter sized for compatibility with a submersible pump, the pump with a top arranged with a discharge and electrical and safety rope connections, a pump suction centrally located, and a bottom arranged with a motor, comprising:

(a) a bottom cap, a first upper cap half and a second upper cap half;

(b) the bottom cap arranged with two or more flow openings each configured with a flow guide and further arranged with an upper surface and one or more protrusions from the upper surface, the protrusions with an insert surface arranged to provide pipe section support and a well pump centering surface arranged to provide radial pump motor support, the upper surface further arranged with an end cover surface section projecting radially outward from the protrusions and arranged to provide a mating surface with the pipe section bottom end, the upper surface further arranged with one or more well pump support surfaces projecting radially inward of the protrusions and arranged to provide axial pump restraint, (c) the first and second upper cap halves each with a mating surface and at least two alignment protrusion/opening combinations arranged to align the two halves mating surfaces;

(d) the aligned first and second upper cap halves providing an insert surface arranged to insert into and mate with the pipe section inside diameter and an end cover surface arranged to mate with the pipe section top end;

(e) the aligned halves also providing a discharge opening arranged to fit around the submersible pump discharge, and at least one wiring/safety rope breakaway opening adjacent to the discharge opening arranged to fit around an electrical wire and a safety rope connected to the submersible pump electrical and safety rope connections; and (f) a multiplicity of removable fasteners installed to retain the upper cap halves and bottom cap whereby the bottom cap is installed on the pipe section bottom opening, the pump is installed into the pipe section top opening and supported radially and axially by the bottom cap protrusion well pump centering surfaces and the well pump support surface respectively, and the upper cap halves are aligned around the submersible pump discharge and electrical wire and safety rope and inserted into the pipe section top opening, providing the pump a cooling fluid flowpath through the bottom cap flow openings around the motor to the pump suction.

2. The installation assembly of claim 1 further comprising the bottom cap flow openings flow guides arranged to provide a swirl motion, whereby fluid flow motion is provided at an angle with a pump centerline.

3. A method of manufacturing an installation assembly for a submersible pump pipe section flow sleeve, including a flow sleeve having a pipe section with a top end and a bottom end comprising:

(a) forming a bottom cap arranged with two or more flow openings each configured with a flow guide, and with an upper surface and one or more protrusions from the upper surface, the protrusions with an insert surface arranged to provide pipe section support and a well pump centering surface arranged to provide radial pump motor support, the upper surface further arranged with an end cover surface section projecting radially outward from the protrusions and arranged to provide a mating surface with the pipe section bottom end, the upper surface further arranged with one or more well pump support surfaces projecting radially inward of the protrusions and arranged to provide axial pump restraint; and (b) forming a first and second upper cap half each with a mating surface and at least two alignment protrusion/opening combinations arranged to align the two halves mating surfaces, the aligned first and second upper cap halves with an insert surface and an end cover surface arranged to insert into and mate with an inside diameter and the top end of the pipe section respectively, the aligned halves also with an adjustable discharge opening.

4. The method of claim 3 further comprising forming a multiplicity of removable fasteners to secure the upper cap halves and bottom cap.

5. The method of claim 3 further comprising arranging the bottom cap flow openings flow guides to provide a swirl motion, whereby fluid flow motion is provided at an angle with a pump centerline.

6. The method of claim 4 further comprising arranging the bottom cap flow openings flow guides to provide a swirl motion, whereby fluid flow motion is provided at an angle with a pump centerline.

7. A submersible pump flow sleeve installation assembly, including a flow sleeve arranged with an upper end and a lower end arranged to install on a pump arranged with an upper end with a pump discharge, a lower end with a pump motor, and pump intake between these ends comprising:

(a) an upper cap and a lower cap each arranged to partially install in the flow sleeve;

(b) the upper cap arranged in two separate halves, a first half and a second half and further arranged with a discharge opening whereby it installs on the pump upper end; and (c) the lower cap arranged with a pump support and one or more flow openings whereby installation of the caps in the flow sleeve, and on the pump, center the pump in the sleeve and provide a flow path from the lower end of the sleeve to the pump intake and out of the pump discharge such that the pump motor receives cooling flow with the pump in operation.

8. The assembly of claim 7 wherein the upper cap halves join at mating surfaces containing at least two alignment protrusion/opening combinations.

9. The assembly of claim 8 wherein the lower cap is arranged with flow guides to provide a swirl motion, whereby fluid flow motion is provided at an angle with a pump centerline.

10. A method of installing a submersible pump flow sleeve made of a pipe section, including providing a pipe section with a top end opening and a bottom end opening; a pump with a top arranged with a discharge and electrical and safety rope connections, a pump suction centrally located, and a bottom arranged with a motor, comprising:

(a) selecting the pipe section with an appropriate inside diameter and wall thickness for the pump;

(b) cutting the pipe section to a length appropriate for the pump, thereby providing the opening at a pipe section bottom end and the opening at a pipe section top end;

(c) selecting a bottom cap configured with an insert surface arranged to fit within the pipe section inside diameter, and with one or more pump centering surfaces, and an end cover surface section formed to provide a mating surface with the pipe section bottom end;

(d) inserting the bottom cap insert surface into the pipe section bottom opening until the end cover surface section is in contact with the pipe section bottom end;

(e) lowering the pump into the pipe section top end opening until the motor is within the pump centering surfaces;

(f) selecting two upper cap halves arranged with two half mating surfaces, such that with the mating surfaces in contact, the two upper cap halves form an upper cap with an insert surface arranged to fit within the pipe section inside diameter, and also form an end cover surface arranged to mate with the pipe section top end, and further form a discharge opening and passage for a pump electrical connection and safety rope;

(g) preparing one or more wiring/safety rope breakaways on the upper cap halves with the passage for the motor electrical connection and a safety rope; and (h) fitting the two upper cap halves around the pump discharge, electrical connection and safety rope and inserting the upper cap insert surface into the pipe section top end opening such that the end cover surface is in contact with the pipe section top end, whereby the flow sleeve is installed on the pump.

11. The method of claim 10 further comprising installing two or more fasteners to secure the bottom cap and upper cap halves to the pipe section.

* * * * *

UNITED STATES PATENT AND TRADEMARK OFFICE

CERTIFICATE OF CORRECTION

PATENT NO. : 9,033,685 B1
APPLICATION NO. : 13/092013
DATED : May 19, 2015
INVENTOR(S) : Rex N. Awalt It is certified that error appears in the above-identified patent and that said Letters Patent is hereby corrected as shown below:

On the title page under item (12),
The Inventor last Name "Await" should read -Awalt-.

On the title page item (76),
The Inventor last Name "Await" should read -Awalt-.

Signed and Sealed this
Twenty-fourth Day of November, 2015

Michelle K. Lee

Michelle K. Lee
*Director of the United States Patent and Trademark Office*